United States Patent [19]

Serati

[11] 4,364,557

[45] Dec. 21, 1982

[54] WORK CONTROL APPARATUS IN AN EXERCISER

[75] Inventor: Ronald A. Serati, St. Louis, Mo.

[73] Assignee: The Perfection Manufacturing Company, St. Louis, Mo.

[21] Appl. No.: 960,765

[22] Filed: Nov. 15, 1978

[51] Int. Cl.[3] ..... A63B 69/16

[52] U.S. Cl. ..... 272/73; 74/10.45; 272/132

[58] Field of Search ..... 272/73, DIG. 4, DIG. 5, 272/72; 73/379, 380, 381, 121, 126, 127, 130; 192/1, 116.5, 139; 291/14, 15; 74/10.45, 10.5, 10.54, 10.7, 63, 822, 506, 553

[56] References Cited

U.S. PATENT DOCUMENTS

| | | | |
|---|---|---|---|
| 1,435,838 | 11/1922 | Gill | 74/63 |
| 1,559,112 | 10/1925 | Lujan | 74/10.45 |
| 4,079,931 | 3/1978 | Valentine et al. | 272/73 |

FOREIGN PATENT DOCUMENTS

| | | | |
|---|---|---|---|
| 235647 | 10/1959 | Australia | 272/72 |
| 730035 | 3/1966 | Canada | 272/73 |
| 942040 | 4/1956 | Fed. Rep. of Germany | 74/10.7 |

*Primary Examiner*—Richard C. Pinkham

*Assistant Examiner*—Arnold W. Kramer

*Attorney, Agent, or Firm*—Cohn, Powell & Hind

[57] ABSTRACT

A work control apparatus in a bicycle exerciser having a driven member rotatively mounted on an exerciser frame. The work control apparatus includes a rotatively mounted knob connected to a brake for the driven member for selectively determining the braking pressure exerted on the driven member. The brake includes a lever pivotally attached to the exerciser frame and having a brake roller at one end engaging the exerciser driven member and the knob is adjustably connected to the other end of the brake lever and is rotatable to exert a predetermined braking pressure between the roller and driven member. The knob is drivingly connected to a rotatively mounted indicator wheel for rotating the wheel an angular distance less than the corresponding angular distance of the knob upon rotation of the knob incident to adjusting the braking pressure. The drive connection between the knob and the indicator wheel includes an idler wheel connected to the knob and the indicator wheel by endless flexible elements and a cover having a window is mounted above the indicator wheel to selectively reveal numerical indicia on the indicator wheel as the knob is rotated.

1 Claim, 7 Drawing Figures

WORK CONTROL APPARATUS IN AN EXERCISER

BACKGROUND OF THE INVENTION

This invention relates generally to improvements in a work control apparatus in an exerciser, and more particularly to an improved apparatus in a bicycle exerciser providing a visual indicator which permits easy and ready adjustment of a brake to a predetermined braking pressure on a driven wheel.

In the heretofore conventional work control apparatus utilized in an exerciser of this type, the control knob, which was used to regulate the braking pressure was also used to indicate the braking pressure. The full range of pressure adjustment required that the knob be rotated a considerable number of revolutions. Thus, it was extremely difficult to readjust the knob to a particular predetermined pressure, once the knob had been moved more than one revolution to provide a different pressure, simply by reliance upon the indicator provided on the knob.

SUMMARY OF THE INVENTION

The present work control apparatus overcomes the functional disadvantages of known conventional apparatus, and readily permits the knob, which regulates the braking pressure, to be rotated to locate to provide any previously determined braking pressure.

The work control apparatus includes a brake means operatively mounted on the exerciser frame and engaging the driven member, a rotatably mounted knob connected to the brake means for selectively determining the brake pressure exerted on the driven member, a rotatively mounted indicator wheel, drive means disposed between the knob and the indicator wheel including endless belt means interconnecting the knob and the indicator wheel in drive relation for rotating the indicator wheel an angular distance less than the corresponding angular distance of the knob upon rotation of the knob incident to adjusting the brake pressure, and indicator means associated with the indicator wheel to indicate the braking pressure applied by the brake means to the driven member at a particular rotatively adjusted position of the knob.

More particularly, the drive means includes a rotatively mounted idler wheel disposed between the knob and the indicator wheel, and the endless element means includes a first endless element interconnecting the knob and the idler wheel in drive relation and a second endless element interconnecting the idler wheel and the indicator wheel in drive relation.

In the preferred embodiment, the indicator means includes a plurality of indicator numerals disposed circumferentially about the indicator wheel and a cover including a window disposed above the indicator wheel for selectively revealing the numerals as the indicator wheel rotates.

The diameter of the knob at the engagement of the first endless element therewith is less than the diameter of the idler wheel at the engagement of said element therewith, and the diameter of the idler wheel at the engagement of the second endless element therewith is less than the diameter of the indicator wheel at the engagement of said element therewith whereby said indicator wheel rotates at a slower rate than said knob.

The brake means includes a brake frame pivotally mounted to the exerciser frame on a pivot axis, a friction member carried by the brake frame at one side of the pivot axis and engaging the driven member and a rod attached to the brake frame at the other side of the pivot axis, the knob being mounted to the rod for longitudinal movement relative thereto.

DESCRIPTION OF THE PREFERRED EMBODIMENTS

Figure 1:
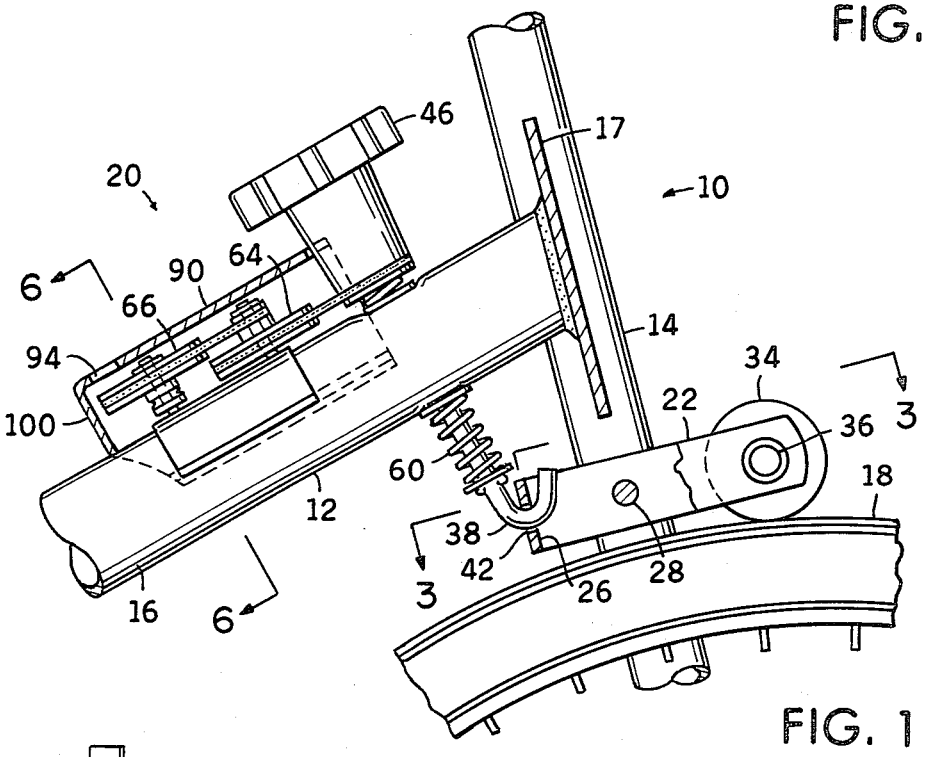
FIG. 1 is an elevational view, partly in cross section, of the work control apparatus in an exerciser.

Referring now by reference numerals to the drawings, and first to FIG. 1, it will be understood that the exerciser 10 is of a bicycle type having an exerciser frame 12 with a front fork portion 14 and an intermediate, longitudinal frame portion 16 having an end plate 17 by which it is attached, as by welding, to the fork portion 14. As is conventional, a wheel 18, constituting a driven member, is rotatively mounted between the frame fork portion 14 and below the longitudinal frame portion 16. Also as is conventional, an appropriate drive means such as a foot pedal and sprocket-chain connection with the driven wheel 18, is provided, but not shown, whereby the user can rotate the driven wheel 18 by leg power.

Figure 3:
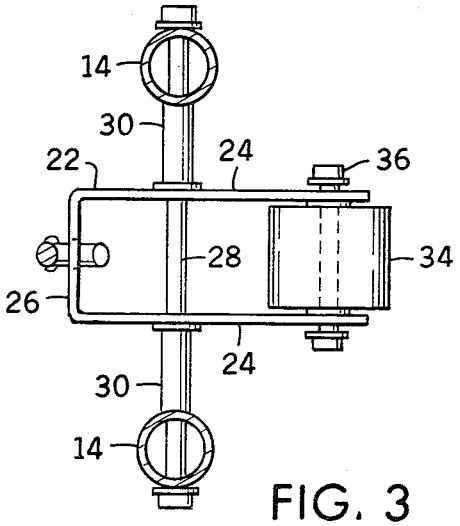
FIG. 3 is a cross-sectional view as taken on staggered line 3—3 of FIG. 1.
Figure 4:
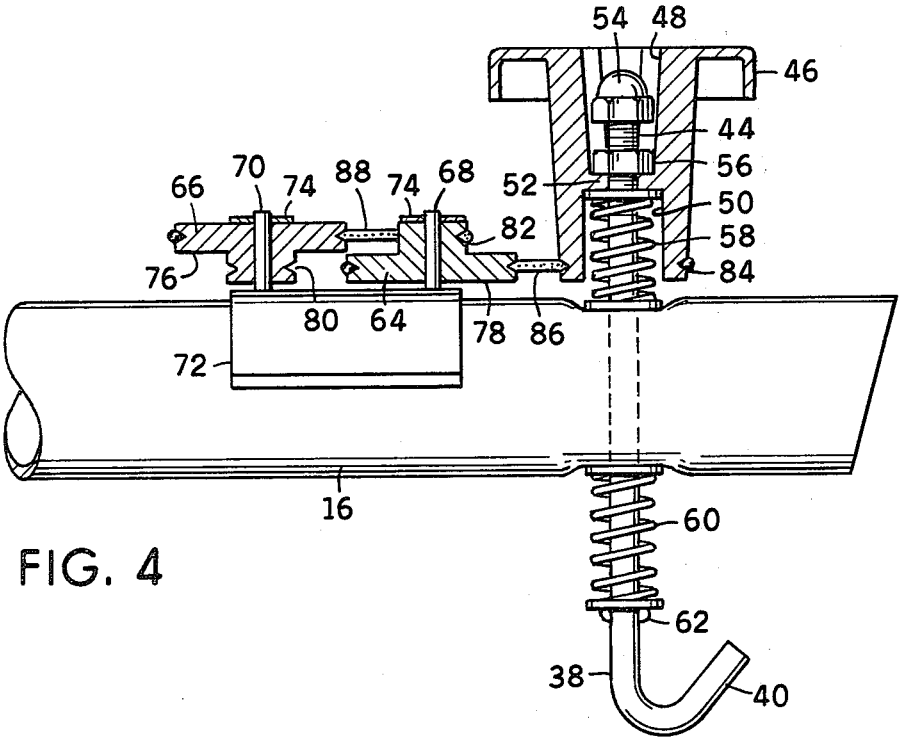
FIG. 4 is an enlarged fragmentary cross-sectional view of the work control apparatus as taken on a longitudinal axis.

The work control apparatus is generally indicated by numeral 20 and includes a brake frame 22 best shown in FIGS. 1 and 3, which is of generally U-shaped configuration and includes a pair of side arms 24 and an integrally formed bight portion 26. The brake frame 22 is pivotally connected to the fork frame portion 14 by means of a pivot pin 28 which extends between the side arms 24 and includes a pair of spaced journal elements 30, welded or otherwise attached to the fork portion 14, which serve to center the brake frame 22. The remote end of the brake frame 22 is provided with a roller 34, constituting a friction member, which is pivotally mounted between and to the side plates 24 by means of a pivot pin 36 providing a pivot axis. As shown in FIG. 1, the roller 34 engages the driven wheel 18 and, as will be readily understood, the frame 22 provides a lever which is pivotable about the pin 28 so that the roller pressure is varied by pivotal movement of the frame 22 about said pin. In the preferred embodiment, such pivotal movement is provided by means of a rod 38 which includes a hook portion 40 which is received within an aperture 42 provided in the brake frame bight member 26. As best shown in FIG. 4, the rod 38 extends freely through the longitudinal frame portion 16 and includes a threaded upper end 44 on which is mounted a manually-actuated knob 46. The knob 46 includes upper and lower socketed portions 48 and 50 separated by a partition, or abutment member 52. The rod 38 is provided with an end cap nut 54 and the socketed upper portion 48 is hexagonal in configuration to receive an adjustment nut 56 in nonrotatable relation said nut being seated on one side of the abutment member 52. The socketed lower portion receives a compression spring 58 which bears on the other side of the abutment member 52 and on the bicycle frame portion 16. A similar compression spring 60 is provided between said frame and a lower shoulder portion 62 provided on the pin 38. As will be readily understood, rotation of the knob 46 about the non-rotating rod 38 tends to move the rod longitudinally along a line defined by its own axis and such movement by the rod exerts an upward or downward pressure on the bight end of the brake frame member thereby tending to increase or decrease the pressure of the roller 34 on the driven wheel 18, depending on the direction of rotation and the extent of angular movement of the knob 46. Importantly, the work control apparatus includes a reduced movement indicator means which proportionately reflects the arcuate movement of the knob 46 as will now be described.

Figure 5:
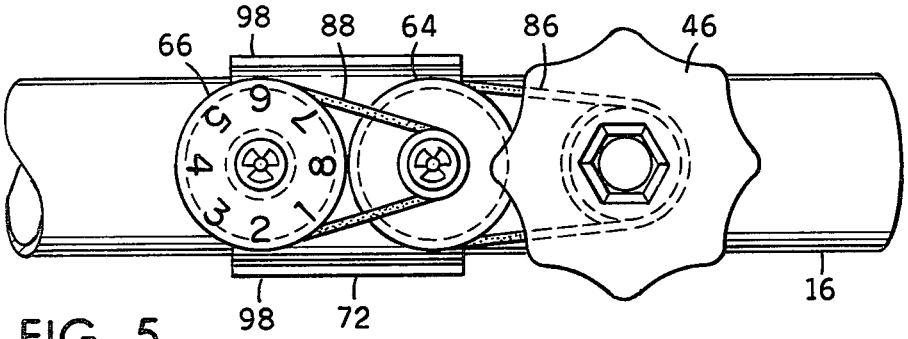
FIG. 5 is a top plan view of the apparatus as it is shown in FIG. 4.
Figure 6:
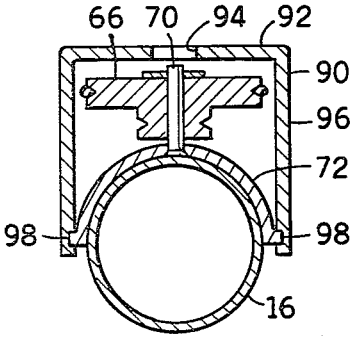
FIG. 6 is an enlarged cross-sectional view as taken on line 6—6 of FIG. 1.
Figure 7:
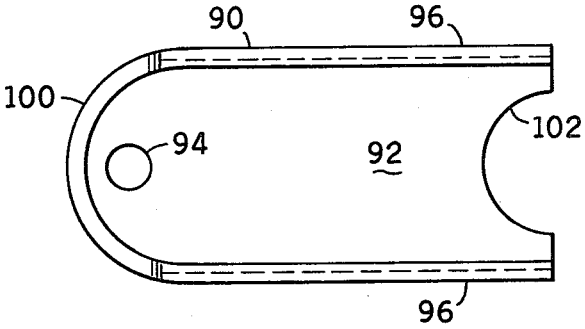
FIG. 7 is a plan view of the indicator cover of FIG. 6, taken from the underside.

As clearly shown in FIGS. 4, 5, and 6, a pair of wheels 64 and 66 respectively are pivotally mounted to the bicycle frame portion 16 by means of pivot pins 68 and 70 respectively which are fixedly attached to a saddle member 72 as by welding, said member 72 being itself attached as by welding at its ends to the frame 16. Each of the pivot pins 68 and 70 is provided with a stop washer 74 at its remote end and associated wheels 64 and 66 respectively are freely rotatable about said pins. In the preferred embodiment, the wheels 64 and 66 are substantially identical but reversely mounted on their associated pivot pins 68 and 70 respectively, each including a relatively large diameter grooved portion 76 or 78 and a relatively reduced diameter grooved portion 80 or 82 respectively. As clearly shown in FIG. 4, the knob 46 includes a grooved portion 84 at its lower end and it will be understood that the grooved portions of the wheels 64 and 66 and of the knob 46, in effect, provide pulley-like configurations adapted to receive belt elements in the form of O-rings 86 and 88 respectively. As clearly shown in FIG. 5, the O-ring 86 interconnects the knob 46 and the wheel 64 while the O-ring 88 interconnects the wheel 64 and the wheel 66.

Importantly, as shown clearly in FIG. 5, the wheel 66 is provided with circumferentially disposed numerical indicia provided in the preferred embodiment by numerals 1 through 8. As will be readily understood, rotation of the knob 46 is transmitted to the wheel 66 by a drive means which includes O-ring 86, wheel 64, and O-ring 88. Thus, as the knob 46 is rotated an angular amount, the wheel 66 is rotated a proportional angular amount depending on the diametrical relationship between the "pulley" portions of the knob 46 and the wheels 64 and 66 engaged by the O-rings. In the embodiment shown, the diameter of the knob at the grooved portion is $\frac{7}{8}''$ and the larger and reduced diameters of each wheel 64 and 66 are respectively $1\frac{3}{8}''$ and $\frac{3}{8}''$. The result of this diametrical sizing arrangement is that it takes approximately six revolutions of the knob 46 to rotate the indicator one revolution.

Figure 2:
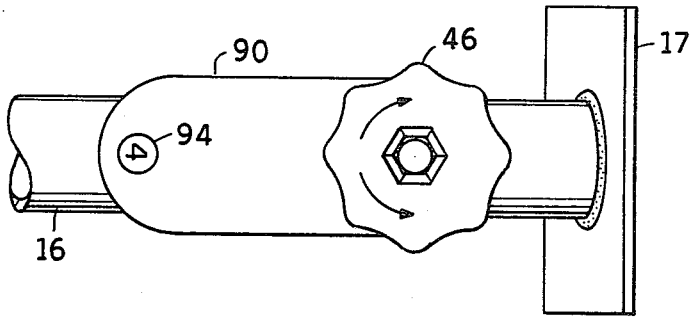
FIG. 2 is a fragmentary top plan view longitudinally of the work control apparatus shown in FIG. 1.

In order to protect the moving wheels and to facilitate reading of the indicator numerals, the work control apparatus 20 includes a cover 90 which is best shown in FIGS. 1, 2, 6, and 7. The cover 90 is generally U-shaped in configuration to include an upper wall 92 (FIGS. 6 and 7) provided with an opening 94 constituting a window; side portions 96 grooved at their lower end to receive elongate ribs 98 of the saddle member 72 in sliding relation; an arcuate end wall 100, and an arcuate cut-out portion 102 receiving the knob 46. When the cover 90 is in place, the window 94, as clearly shown in FIG. 2, is disposed above the indicator wheel 66 so as to selectively reveal the numerals 1 through 8. Because of the drive relationship between the knob 46 and the indicator wheel 66 discussed above, it takes six revolutions of the knob to rotate the indicator wheel through a complete revolution successively revealing numerals 1 through 8. This relatively slow rate of movement of the indicator wheel 66 thereby provides a very simple means of re-adjusting the pressure of the brake roller 34 on the driven wheel 18 by simply noting the corresponding window reading prior to adjustment to a different pressure. In this way the original pressure can be readily returned to by reversing rotation until the number previously noted once again appears within the window 94.

I claim as my invention:

1. A work control apparatus in an exerciser having a frame, and a driven member rotatively mounted on the frame, the apparatus comprising:

(a) a brake means operatively mounted on the exerciser frame and engaging the driven member, (b) a rotatively mounted knob connected to the brake means for selectively determining the braking pressure exerted on the driven member, (c) a rotatively mounted indicator wheel, (d) drive means between the knob and the indicator wheel including flexible endless element means interconnecting the knob and the indicator wheel in drive relation for rotating the indicator wheel an angular distance less than the corresponding angular distance of the knob upon rotation of the knob incident to adjusting the brake pressure, (e) indicator means associated with the indicator wheel to indicate the braking pressure applied by the brake means to the driven member at a particular rotatively adjusted position of the knob, (f) the drive means including a rotatively mounted idler wheel disposed between the knob and the indicator wheel, (g) the flexible endless element means including a first flexible endless element interconnecting the knob and the idler wheel in drive relation, and a second flexible endless element interconnecting the idler wheel and the indicator wheel in drive relation, (h) the idler wheel including an enlarged portion and a reduced portion, (i) the first flexible endless element engaging the knob and the enlarged portion of the idler wheel, and the second flexible endless element engaging the reduced portion of the idler wheel and the indicator wheel, and (j) the indicator wheel and the idler wheel being substantially identically formed but being reversely mounted relative to the exerciser frame.

* * * * *